United States Patent [19]

Grimberg et al.

[11] 4,396,920

[45] Aug. 2, 1983

[54] BROAD-BAND SMALL-SIZE RADIO-FREQUENCY ANTENNA SYSTEM

[76] Inventors: David Grimberg, 8 Hakibutzim St., Kiryat Chaim; Yoram Kol, 12 Hate'enim St., Kiryat Bialik, both of Israel

[21] Appl. No.: 171,428

[22] Filed: Jul. 23, 1980

[30] Foreign Application Priority Data

Dec. 9, 1979 [IL] Israel ..... 58902

[51] Int. Cl.[3] ..... H01Q 1/48; H01Q 9/36

[52] U.S. Cl. ..... 343/846; 343/752

[58] Field of Search ..... 343/846, 722, 794, 725, 343/729, 895, 830, 831, 708, 749, 752, 802

[56] References Cited

U.S. PATENT DOCUMENTS

| | | | |
|---|---|---|---|
| 3,967,276 | 6/1976 | Goubau | 343/752 |
| 4,083,050 | 4/1978 | Hall | 343/722 |
| 4,149,169 | 4/1979 | Weber | 343/846 |

*Primary Examiner*—David K. Moore

*Attorney, Agent, or Firm*—Benjamin J. Barish

[57] ABSTRACT

A broad-band, small-size radio-frequency antenna system includes a transmission line antenna feeding a monopole antenna, the antenna system exploiting the opposite narrow-band characteristics of the above antennas so as to complement each other and to produce an antenna system of broad-band monopole antenna characteristics.

9 Claims, 4 Drawing Figures

BROAD-BAND SMALL-SIZE RADIO-FREQUENCY ANTENNA SYSTEM

BACKGROUND OF THE INVENTION

The present invention relates to radio-frequency antenna systems, and particularly to antenna systems having broad-band characteristics.

Resonant-element type antennas, such as the conventional monopole, dipole, loop, or transmission-line types, have impedance characteristics which vary greatly with frequency, and therefore are normally used only as narrow-frequency band antennas. Wide band antenna systems are usually of the non-resonant type, e.g. cylindrical, conical, spheroidal, diamond, logarithmic, but these usually require substantially large sizes, particularly for the VHF and UHF ranges.

An object of the present invention is to provide a radio-frequency antenna system having both broad-band monopole antenna characteristics and also relatively small physical size.

SUMMARY OF THE INVENTION

According to a broad aspect of the present invention, there is provided a broad-band radio-frequency antenna system characterized in that it includes a transmission line antenna coupled to a monopole antenna.

More particularly, the novel antenna system includes a ground plane, a first bar extending therethrough substantially at a right angle to the groud plane, a second bar connected to the first bar and extending substantially parallel to the ground plane to form a transmission line antenna therewith, and a third bar connected to the end of the second bar opposite to the first bar and extending away from the ground plane substantially at a right angle thereto to define a monopole antenna.

In the preferred embodiment of the invention described below, there are four of said second bars defining four transmission line antennas fixed to the first bar (constituting a central bar) at right angles to each other and extending parallel to the ground plane, and four of the third bars, constituting monopole antennas, each fixed to the end of one of the second bars (transmission-line antennas) and extending parallel to the axis of the central bar. Also, the described antenna system further includes a multi-turn inductance coil fixed to the end of each of the third bars (monopole antennas) and coaxial therewith.

The invention thus exploits the opposite narrow band impedance characteristics of the transmission-line antennas and the monopole antennas so as to complement each other and thereby to produce an antenna system of broad-band characteristics and yet of relatively small physical size. The length of each of the transmission-line antennas and of the monopole antennas may be tuned in a manner, as will be described more particularly below. such that, in every frequency in the band width, a maximum matching of the input impedance is obtained to the desired value, 50 ohms in the described example. Thus, the invention not only enables the construction of antenna systems of large band-width and of small physical sizes, but also obviates the need of matching networks, and therefore enables higher gains to be obtained and higher powers to be transmitted.

Particularly good results have been obtained when the above elements, particularly the lengths of the bars defining the four transmission-line antennas and the four monopole antennas, have specific relationships with respect to the wavelength of the lowest frequency in the antenna system band-width, as will be described more particularly below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
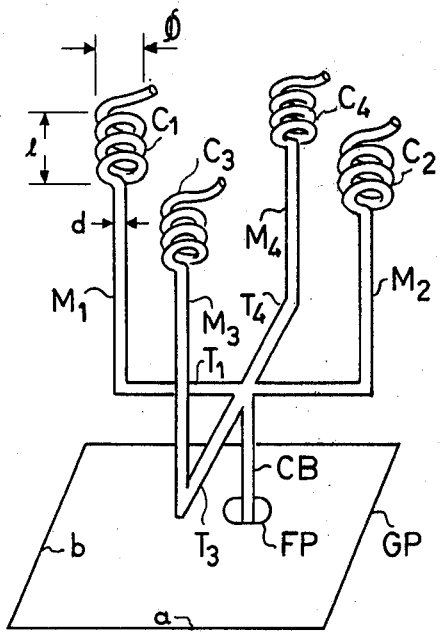
FIG. 1 illustrates one form of radio-frequency antenna system constructed in accordance with the invention.

With reference to FIG. 1, there is illustrated an antenna system constructed in accordance with the invention and including a ground plane GP of electrically-conductive material, such as copper; a first or central bar CB extending at right angles centrally through the ground plane; four second bars $T_1$–$T_4$ connected to the central bar CB and extending substantially at right angles to each other and parallel to the ground plane GP to form four transmission line antennas therewith; four third bars each fixed to one end of the transmission line antennas (the second bars) $T_1$–$T_4$ opposite their connections to the central bar CB, extending substantially parallel to each other and to the axis of the central bar CB and away from the ground plane GP substantially at a right angle thereto to define four monopole antennas each fed by one of the transmission line antennas; and four inductance coils $C_1$–$C_4$ each fixed to one end of the monopole antennas.

More particularly, the ground plane GP is of square configuration. The central bar CB passes through its center and is connected thereto, e.g. by a conventional coaxial connection, to constitute the feeding point FP of the antenna system.

Actually, the four transmission line antennas $T_1$–$T_4$ and the four monopole antennas $M_1$–$M_4$ may be constituted of two U-shaped electrically-conductive rods or wires of circular cross-section mounted to the central bar CB so as to be at right-angles to each other, with the four outer legs of the two U-shaped rods constituting the four monopole antennas $M_1$–$M_4$, and the two bridging legs of the two U-shaped rods constituting the four transmission line antennas $T_1$–$T_4$.

The four inductance coils $C_1$–$C_4$ are each of four turns, each coil, as indicated above, being fixed to one end of the monopole antennas $M_1$–$M_4$ and coaxial thereto.

An antenna system has been constructed in accordance with the arrangement illustrated in FIG. 1 and having the following dimensions with respect to the wavelength (λ) of the lowest frequency of the antenna system frequency band.

| | | |
|---|---|---|
| $M_1 = 0.1133\ \lambda$ | $T_1 = 0.0316\ \lambda$ | $d = 0.001\ \lambda$ |
| $M_2 = 0.0866\ \lambda$ | $T_2 = 0.0366\ \lambda$ | $h = 0.0166\ \lambda$ |
| $M_3 = 0.12\ \lambda$ | $T_3 = 0.035\ \lambda$ | $\phi = 0.007\ \lambda$ |
| $M_4 = 0.133\ \lambda$ | $T_4 = 0.033\ \lambda$ | $l = 0.007\ \lambda$ |
| | | $a = 0.25\ \lambda$ |
| | | $b = 0.25\ \lambda$ |

Figure 2:
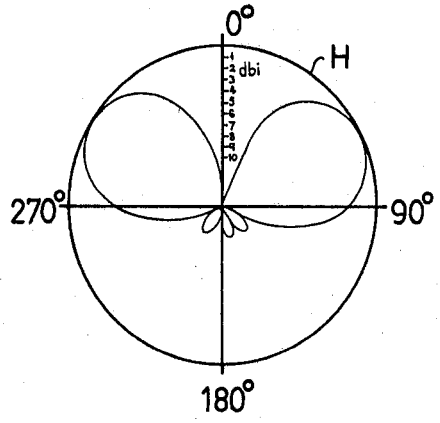
FIGS. 2–4 illustrate certain measured characteristics of the antenna system illustrated in FIG. 1 having the specific dimensional parameters as to be described below.
Figure 3:
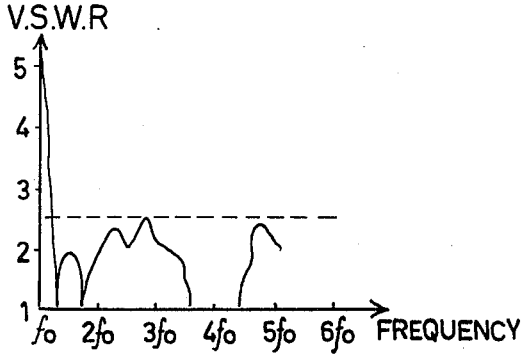
Figure 4:
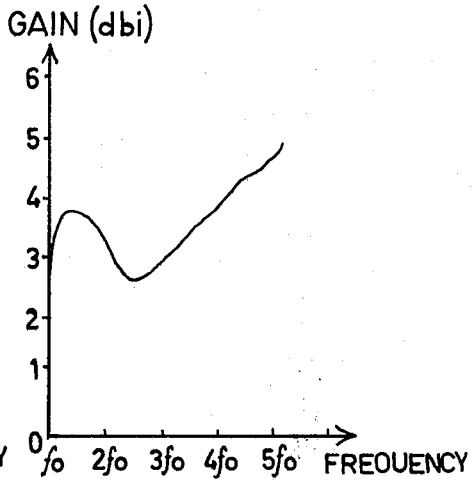

FIGS. 2–4 illustrate certain measured characteristics of the antenna system illustrated in FIG. 1 and having the above parameters, wherein the diameter of all of the antennas and of the central bar CB is the same (d), and the diameter of the central opening in the ground plane GP defining the feeding point FP is less than 1/30λ and is connected to the central bar CB by a 50-ohm impedance coaxial connector.

Thus, FIG. 2 shows the radiation pattern of the illustrated antenna system, curve "H" representing azimuth or the H-plane, and curve "E" representing elevation or the E-plane, wherein it will be seen that the radiation pattern is substantially the same as a standard monopole antenna. FIG. 3 illustrates the measured relationship of VSWR (Voltage Standing Wave Ratio) with respect to frequency, wherein it will be seen that the VSWR is within the 1–2.5 range for substantially the complete frequency band, meeting the usual requirements for transmitter antennas. FIG. 4 indicates the measured gain (dbi) with respect to frequency, wherein it will be seen that the gain is substantially in excess of 1.5 dbi, varying from 2 to 6 for most of the frequency band. This compares very favorably to the standard monopole antenna wherein the gain is about 1.5 dbi for its narrow frequency band, and also the standard transmission-line antenna wherein the gain is about 1.0 dbi for its narrow frequency band.

The above-described characteristics illustrated in FIGS. 2–4 show that the antenna system illustrated in FIG. 1 has substantially monopole antenna characteristics but of broader band than the conventional resonant-element type monopole antenna.

The right angle orientations of the antennas to each other and to the ground plane have been found to be optimum, but it has also been found that variations in these angles, e.g. by the wind, produce relatively small changes in gain and VSWR, which is another advantage of the described system.

While the invention has been described with respect to one preferred embodiment, it will be appreciated that many variations, modifications and other applications of the invention may be made.

What is claimed is:

1. A broad-band radio-frequency antenna system characterized in that it includes a ground plane; a first bar extending therethrough substantially at a right angle to the ground plane; a second bar connected to said first bar and extending substantially parallel to said ground plane, said second bar being located and dimensioned to form a transmission line antenna with said ground plane; and a third bar connected to the end of said second bar opposite to said first bar and extending away from said ground plane substantially at a right angle thereto to define an antenna having broad-band monopole antenna characteristics.

2. An antenna system according to claim 1, further characterized in that it also includes a multi-turn inductance coil fixed to the end of said third bar and coaxial therewith.

3. An antenna system according to claim 1, wherein there are four of said second bars fixed to said first bar at right angles to each other and extending parallel to the ground plane, and four of said third bars each fixed to the end of one of said second bars and extending parallel to the axis of said first bar.

4. An antenna system according to claim 3, wherein said second bars ($M_1$–$M_4$) and said first bars ($T_1$–$T_4$) have the following lengths with respect to the wavelength (λ) of the lowest frequency in the frequency band of the antenna system:

| | |
|---|---|
| $M_1 = 0.1133\ \lambda$ | $T_1 = 0.0316\ \lambda$ |
| $M_2 = 0.0866\ \lambda$ | $T_2 = 0.0366\ \lambda$ |
| $M_3 = 0.12\ \lambda$ | $T_3 = 0.035\ \lambda$ |
| $M_4 = 0.133\ \lambda$ | $T_4 = 0.033\ \lambda$. |

5. An antenna system according to claim 4, wherein the ground plane is of square configuration having a length of ¼λ along each side.

6. An antenna system according to claim 5, wherein the height of said first bar is 0.0166λ, and its diameter is 0.001λ and is equal to that of all said second and third bars.

7. An antenna system according to claim 6, further including a multi-turn coil fixed to the end of each of said second bars and coaxial thereto.

8. An antenna system, according to claim 7, wherein the length and the diameter of each of said coils are both 0.007λ.

9. An antenna system according to claim 4, wherein a multi-turn inductance coil is fixed to the end of each of said second bars and coaxial thereto, the lengths ($M_1$–$M_4$) of the four second bars, the lengths ($T_1$–$T_4$) of the four first bars, the diameter (d) of the first and second bars, the height (h) of the first bar, the diameter (ϕ) and the length (l) of each coil, and the length (a) and width (b) of the ground plane, all having the following relationships with respect to the wave length (λ) of the lowest frequency antenna system frequency band:

| | | |
|---|---|---|
| $M_1 = 0.1133\ \lambda$ | $T_1 = 0.0316\ \lambda$ | $d = 0.001\ \lambda$ |
| $M_2 = 0.0866\ \lambda$ | $T_2 = 0.0366\ \lambda$ | $h = 0.0166\ \lambda$ |
| $M_3 = 0.12\ \lambda$ | $T_3 = 0.035\ \lambda$ | $\phi = 0.007\ \lambda$ |
| $M_4 = 0.133\ \lambda$ | $T_4 = 0.033\ \lambda$ | $l = 0.007\ \lambda$ |
| | | $a = 0.25\ \lambda$ |
| | | $b = 0.25\ \lambda$. |

* * * * *

UNITED STATES PATENT AND TRADEMARK OFFICE

CERTIFICATE OF CORRECTION

PATENT NO. : 4,396,920

DATED : August 2, 1983

INVENTOR(S) : David Grimberg

It is certified that error appears in the above-identified patent and that said Letters Patent is hereby corrected as shown below:

On the title page:

Item [76] delete "Yoram Kol, 12 Hate'enim St., Kiryat Bialik, both of".

Signed and Sealed this

Third Day of April 1984

[SEAL]

Attest:

GERALD J. MOSSINGHOFF

Attesting Officer

Commissioner of Patents and Trademarks